US012161203B2

(12) United States Patent
Hermanson et al.

(10) Patent No.: US 12,161,203 B2
(45) Date of Patent: Dec. 10, 2024

(54) UMBRELLA HAVING A CAM ASSEMBLY

(71) Applicant: Terry Hermanson, New York, NY (US)

(72) Inventors: Terry Hermanson, New York, NY (US); Huang Meng-Suen, Hong Kong (CN)

(73) Assignee: Terry Hermanson, New York, NY (US)

( * ) Notice: Subject to any disclaimer, the term of this patent is extended or adjusted under 35 U.S.C. 154(b) by 0 days.

(21) Appl. No.: 18/152,830

(22) Filed: Jan. 11, 2023

(65) Prior Publication Data

US 2023/0148719 A1 May 18, 2023

Related U.S. Application Data

(63) Continuation of application No. PCT/US2021/041280, filed on Jul. 12, 2021.

(60) Provisional application No. 63/050,812, filed on Jul. 12, 2020.

(51) Int. Cl.

| | |
|---|---|
| ***A45B 25/14*** | (2006.01) |
| ***A45B 25/02*** | (2006.01) |
| ***A45B 25/10*** | (2006.01) |

(52) U.S. Cl.

CPC ..... *A45B 25/14* (2013.01); *A45B 25/02* (2013.01); *A45B 25/10* (2013.01); *A45B 2025/105* (2013.01); *A45B 2200/1081* (2013.01)

(58) Field of Classification Search

CPC ... A45B 25/14; A45B 25/10; A45B 2025/105; A45B 2200/1081; A45B 2023/0087

See application file for complete search history.

(56) References Cited

U.S. PATENT DOCUMENTS

| | | | | |
|---|---|---|---|---|
| 167,070 A | | 8/1875 | Colby et al. | |
| 1,833,004 A | * | 11/1931 | Spiro | A45B 19/00 135/25.4 |
| 1,998,291 A | | 4/1935 | Sherman | |
| 2,479,250 A | | 8/1949 | Mote | |
| 3,146,785 A | | 9/1964 | Wasaku | |
| 4,736,761 A | * | 4/1988 | Warfield | A45B 25/14 135/22 |

(Continued)

FOREIGN PATENT DOCUMENTS

| | | |
|---|---|---|
| EP | 0444965 A1 | 9/1991 |
| GB | 266699 A | 5/1927 |

(Continued)

*Primary Examiner* — Noah Chandler Hawk

(74) *Attorney, Agent, or Firm* — Venable LLP

(57) ABSTRACT

An umbrella including a support shaft, a plurality of ribs, a rotatable cam assembly, and a canopy. Each rib of the plurality of ribs has a proximal end portion and a distal end portion. The proximal end portion is pivotably attached to an upper portion of the support shaft to pivot the rib between an open position and a closed position. The rotatable cam assembly includes a cam configured to rotate about a longitudinal axis of the support shaft. The cam is engaged with each rib of the plurality of ribs such that (i) each rib moves in a direction from the closed position to the open position when the cam rotates in a first direction and (ii) each rib moves in a direction from the open position to the closed position when the cam rotates in a second direction, the second direction being opposite the first direction.

20 Claims, 9 Drawing Sheets

(56) References Cited

U.S. PATENT DOCUMENTS

| | | | | |
|---|---|---|---|---|
| 4,934,394 | A | 6/1990 | Hermanson | |
| 7,802,580 | B2 * | 9/2010 | Hermanson | A45B 25/02 135/25.4 |
| 8,640,720 | B1 * | 2/2014 | Roberto | A45B 19/06 135/33.5 |
| 8,800,577 | B2 | 8/2014 | Ma et al. | |
| 9,888,751 | B2 * | 2/2018 | Nagelberg | A45B 25/14 |
| 2008/0190469 | A1 * | 8/2008 | Amsel | A45B 19/00 135/22 |
| 2009/0071518 | A1 | 3/2009 | Amsel | |

FOREIGN PATENT DOCUMENTS

| | | | |
|---|---|---|---|
| WO | 87/04603 | A1 | 6/1987 |
| WO | 2016/104929 | A1 | 6/2016 |

* cited by examiner

UMBRELLA HAVING A CAM ASSEMBLY

CROSS-REFERENCE TO RELATED APPLICATIONS

This application is a continuation of International Patent Application No. PCT/US21/41280, filed Jul. 12, 2021, which claims the benefit under 35 U.S.C. § 119 (e) of U.S. Provisional Patent Application No. 63/050,812, filed Jul. 12, 2020, and titled "SPIRAL-SPOKED UMBRELLA," the entirety of which is incorporated herein by reference.

FIELD OF THE INVENTION

The invention relates to umbrellas.

BACKGROUND OF THE INVENTION

Umbrellas are designed to protect a user against natural elements, such as sunlight and precipitation, like rain and snow. When a conventional umbrella is open, strong wind gusts can strike the underside of the canopy, causing the stretchers to bend in an upward direction, thereby inverting the dome-like shape of the canopy. This renders the umbrella ineffective in protecting a user from the natural elements. Further, such an inversion may cause the stretchers to break and, therefore, the umbrella to become unusable.

SUMMARY OF THE INVENTION

In one aspect, the invention relates to an umbrella including a support shaft, a plurality of ribs, a rotatable cam assembly, and a canopy. The support shaft includes an upper portion, a lower portion, and a longitudinal axis. Each rib of the plurality of ribs has a proximal end portion and a distal end portion. The proximal end portion is pivotably attached to the upper portion of the support shaft to pivot the rib between an open position and a closed position. The rotatable cam assembly includes a cam configured to rotate about the longitudinal axis. The cam is engaged with each rib of the plurality of ribs such that (i) each rib moves in a direction from the closed position to the open position when the cam rotates in a first direction and (ii) each rib moves in a direction from the open position to the closed position when the cam rotates in a second direction, the second direction being opposite the first direction. The canopy has an inner edge and an outer edge attached to the distal end portion of each of the ribs.

In another aspect, the invention relates to an umbrella including a support shaft, a plurality of ribs, a rotatable cam assembly, a fixed handle, and a canopy. The support shaft includes an upper portion, a lower portion, and a longitudinal axis. Each rib of the plurality of ribs has a proximal end portion, a distal end portion, and a slot formed in the proximal end portion. The slot includes a proximal end and a distal end. The proximal end portion of each rib being pivotably attached to the upper portion of the support shaft to pivot the rib between an open position and a closed position. The rotatable cam assembly includes a cam, a movable handle, a rotatable shaft and a fixed handle. The cam is configured to rotate about the longitudinal axis. The cam includes a plurality of radially projecting rods. Each rod is engaged with the slot in a corresponding one of the ribs to slide in the slot. The movable handle is configured to rotate about the longitudinal axis. The rotatable shaft connects the movable handle to the cam such that, when the movable handle is rotated about the longitudinal axis, the movable handle rotates the rotatable shaft about the longitudinal axis, and the rotatable shaft rotates the cam assembly about the longitudinal axis. The fixed handle is connected to the lower portion of the support shaft. The canopy has an inner edge centrally mounted to the upper portion of the support shaft and an outer edge attached to the distal end portion of each of the ribs. When the movable handle rotates in a first direction, each rod slides in the corresponding slot from the proximal end to the distal end to move the corresponding rib from the closed position to the open position. When the movable handle rotates in a second direction, each rod slides in the corresponding slot from the distal end to the proximal end to move the corresponding rib from the open position to the closed position.

These and other aspects of the invention will become apparent from the following disclosure.

BRIEF DESCRIPTION OF THE DRAWINGS

FIG. 3A is a top orthographic view of the canopy with certain features of the umbrella 100, and FIG. 3B is a side orthographic view of the canopy.

FIG. 9 also shows the handle and includes a cross section of the opening and closing features located near the handle.

DETAILED DESCRIPTION OF THE PREFERRED EMBODIMENTS

Figure 1:
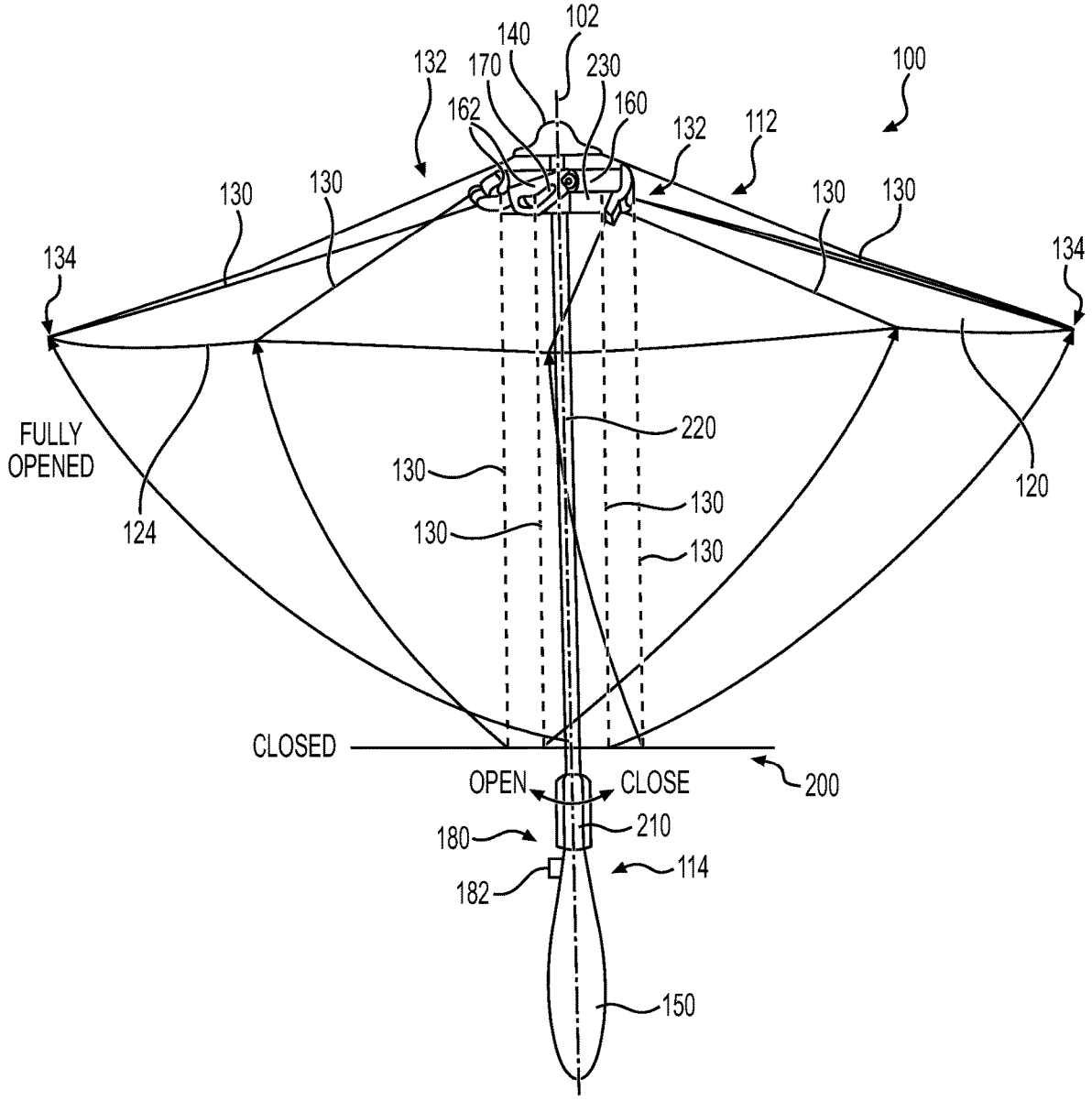
FIG. 1 is a side orthographic view of an umbrella according to a preferred embodiment of the invention.

In the description of preferred embodiments of the invention, the terms "inner" and "outer" are used in relation to an inner side and an outer side of a canopy of an umbrella, respectively, and are interchangeable with the terms "interior" and "exterior," respectively. The terms "upper" and "lower" are used in relation to an upper end and a lower end of a support shaft, respectively, when the umbrella is oriented upright, as shown in FIG. 1. In addition, the terms "distal" and "proximal" are used in relation to the support shaft. More specifically, "proximal" refers to a position relatively closer to the support shaft, and "distal" refers to a position relatively farther from the shaft.

Figure 4:
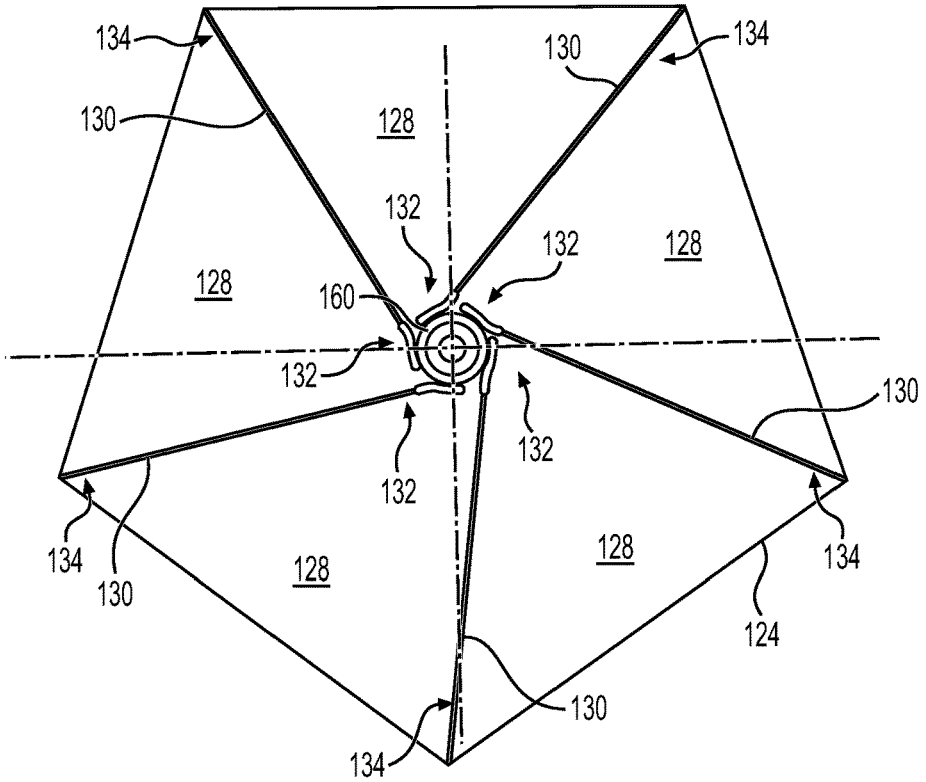
FIG. 4 is a bottom orthographic view of the umbrella shown in FIG. 1.

FIG. 1 shows an umbrella 100 in accordance with a preferred embodiment of the invention. FIG. 1 is a side orthographic view of the umbrella 100 and FIG. 4 is a bottom orthographic view of the umbrella shown in FIG. 1. The umbrella 100 includes a support shaft 110 (see FIG. 9) and a canopy 120 supported by a plurality of ribs 130. The support shaft 110 includes an upper portion 112 and a lower portion 114. Each of the ribs 130 is movable between a closed position and an open position. The broken lines in FIG. 1 illustrate the ribs 130 in the closed position. Each of the ribs 130 includes a proximal end portion 132 and a distal end portion 134. The proximal end portion 132 is pivotably attached to the upper portion 112 of the support shaft 110, and the distal end portion 134 pivots upward from the closed position to the open position as illustrated in FIG. 1.

Figure 2:
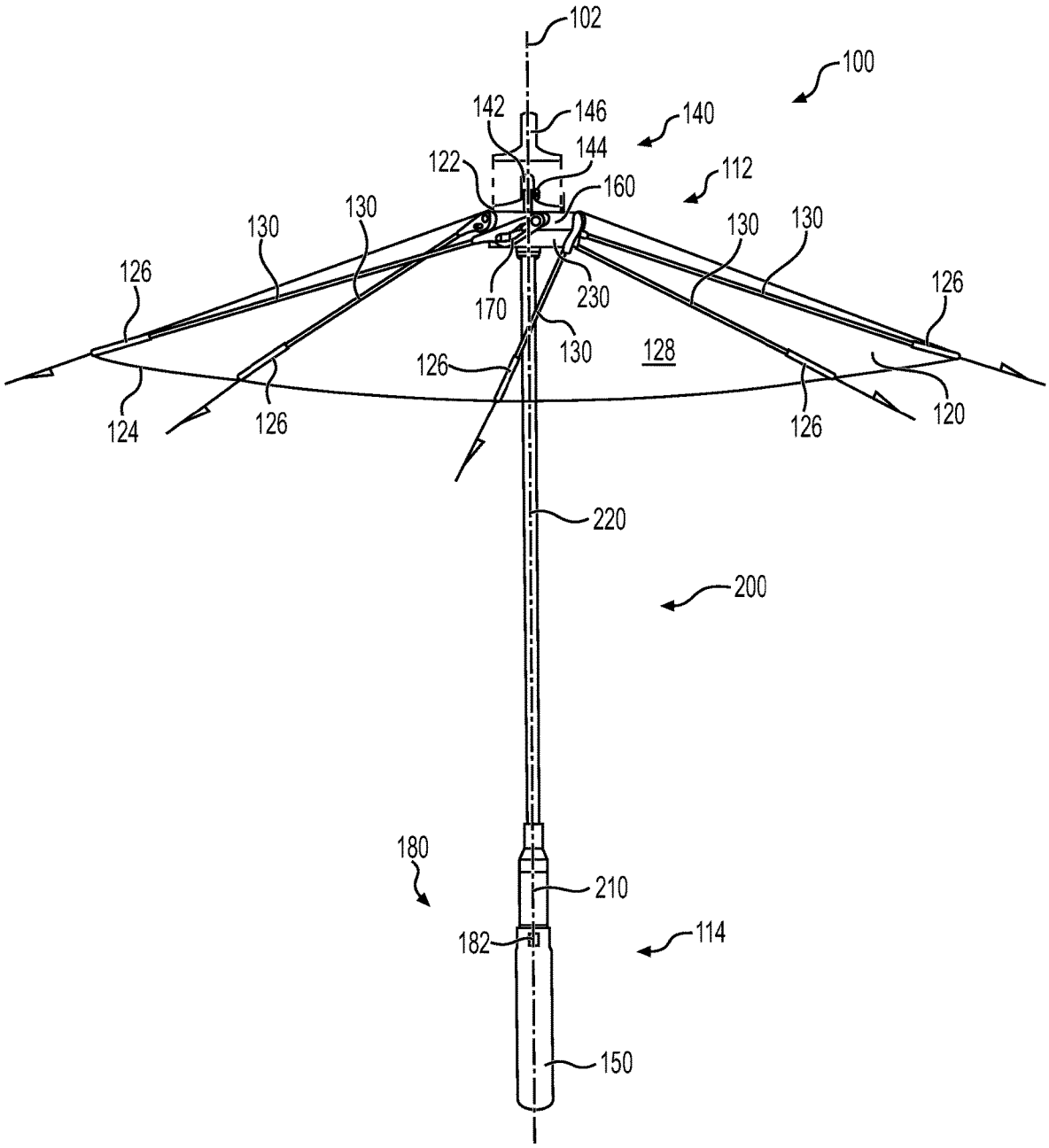
FIG. 2 is a side orthographic view of the umbrella shown in FIG. 1 illustrating how a canopy of the umbrella can be replaced.
Figure 3A:
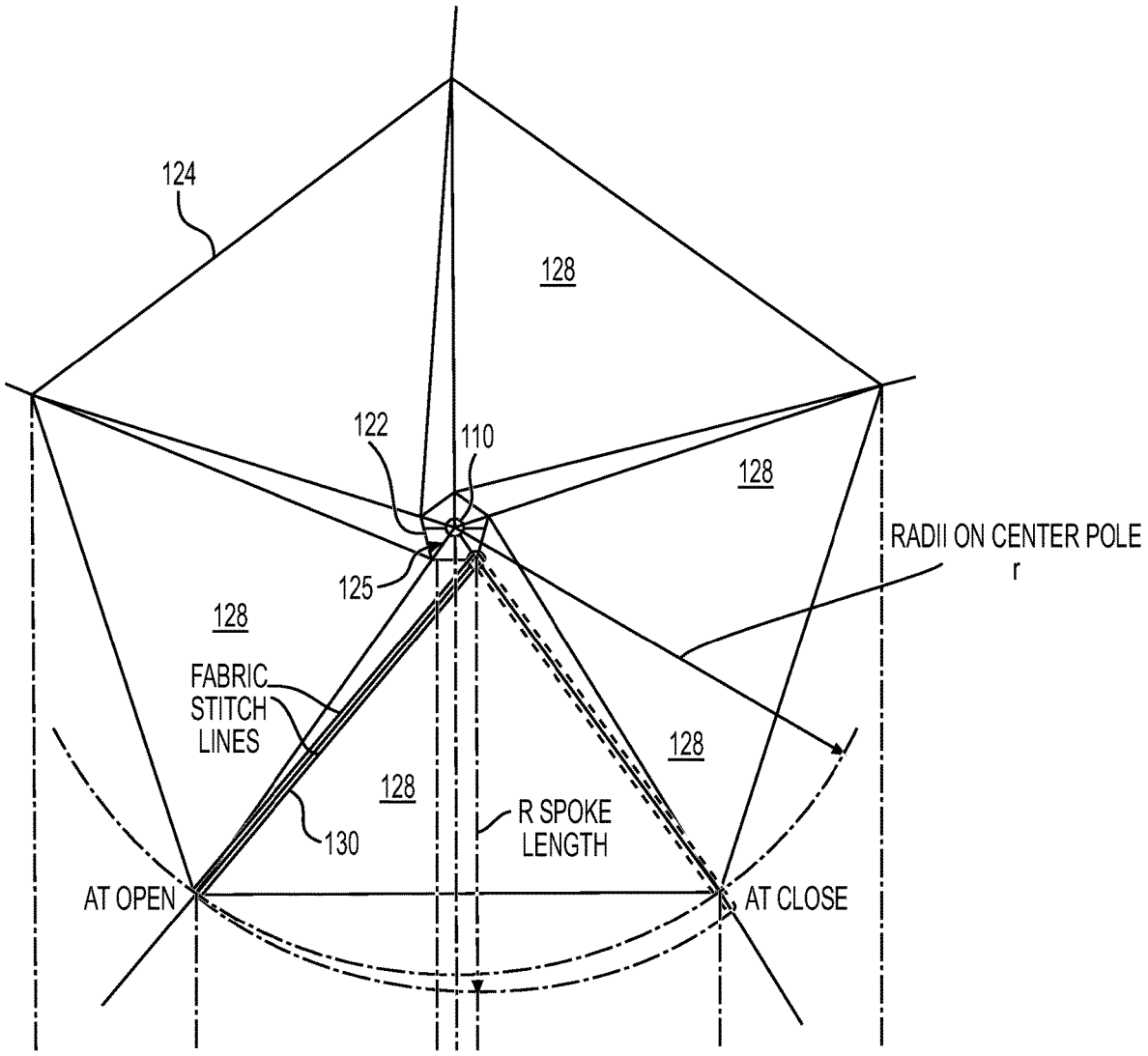
FIGS. 3A and 3B show the canopy of the umbrella shown in FIG. 1.
Figure 3B:
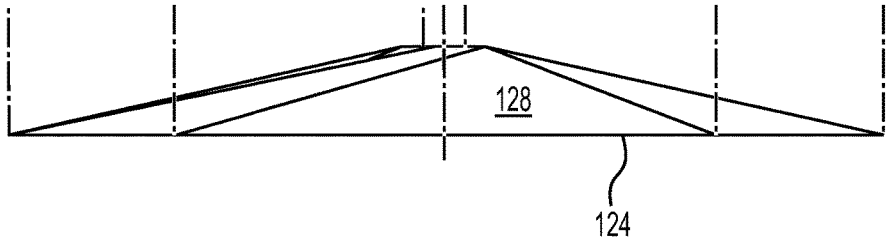

FIG. 2 is a side orthographic view of the umbrella 100 illustrating features of the canopy 120 and how the canopy 120 can be replaced. FIGS. 3A and 3B also show the canopy 120. FIG. 3A is a top orthographic view of the canopy 120 with certain features of the umbrella 100, and FIG. 3B is a side orthographic view of the canopy 120. The canopy 120 may be formed of any suitable material, such as waterproof (or resistant) fabric or plastic, to protect the user from the natural elements, such as sunlight and precipitation, like rain and snow. Although the canopy 120 will typically be an opaque material, the canopy 120 is shown as a transparent material in FIGS. 1 and 4 for clarity to illustrate various features of the umbrella 100. The canopy 120 is connected to the support shaft 110 at the upper portion 112. The canopy 120 includes an inner edge 122 and an outer edge 124. The inner edge 122 may be, for example, the edge of a central hole 125 formed in the canopy 120. In this embodiment, the inner 122 has the same geometric shape as the outer edge 124. The inner edge 122 is centrally mounted to the upper portion of the support shaft 110 by a cap assembly 140. The cap assembly 140 may include an adaptor 142 that has a central hole (bore) into which the upper portion 112 of the support shaft 110, and more specifically the upper tip, may be inserted. The adaptor 142 may be secured to the support shaft 110 by any suitable means including, for example, a set screw 144. The adaptor 142, and thus the canopy 120, of this embodiment is detachably attached to the support shaft 110 to facilitate easy replacement of the canopy 120 if the canopy 120 becomes damaged. The adaptor 142 of this embodiment has a circular outer edge to which the inner edge 122 of the canopy 120 is attached by a suitable means such as by compression in a slot and/or adhesive. In this embodiment, the cap assembly 140 includes a top cap 146 that fits over the adaptor 142. The top cap 146 provides a decorative cover for the adaptor 142 and set screw 144. The top cap 146 is detachably attached to the adaptor 142 by any suitable means, such as by snap engagement with the adaptor 142.

The outer edge 124 of the canopy 120 is attached to the distal end portion 134 of each of the ribs 130 by any suitable connection known in the art. In this embodiment, a plurality of receivers 126 are formed on the underside of the canopy 120. Each receiver 126 is configured to slide over the distal end portion 134, and more specifically the distal tip, of each rib 130. To remove the canopy 120, the top cap 146 is first removed by disengaging the snap engagement features and lifting the top cap 146 from the adaptor 142. The set screw 144 is then loosened to detach the adaptor 142 from the support shaft 110. The adaptor 142 can then be moved to provide slack in the canopy 120 and allow each receiver 126 to slide off of the distal end portion 134 of each rib 130. The process is reversed to install the canopy 120.

Figure 5:
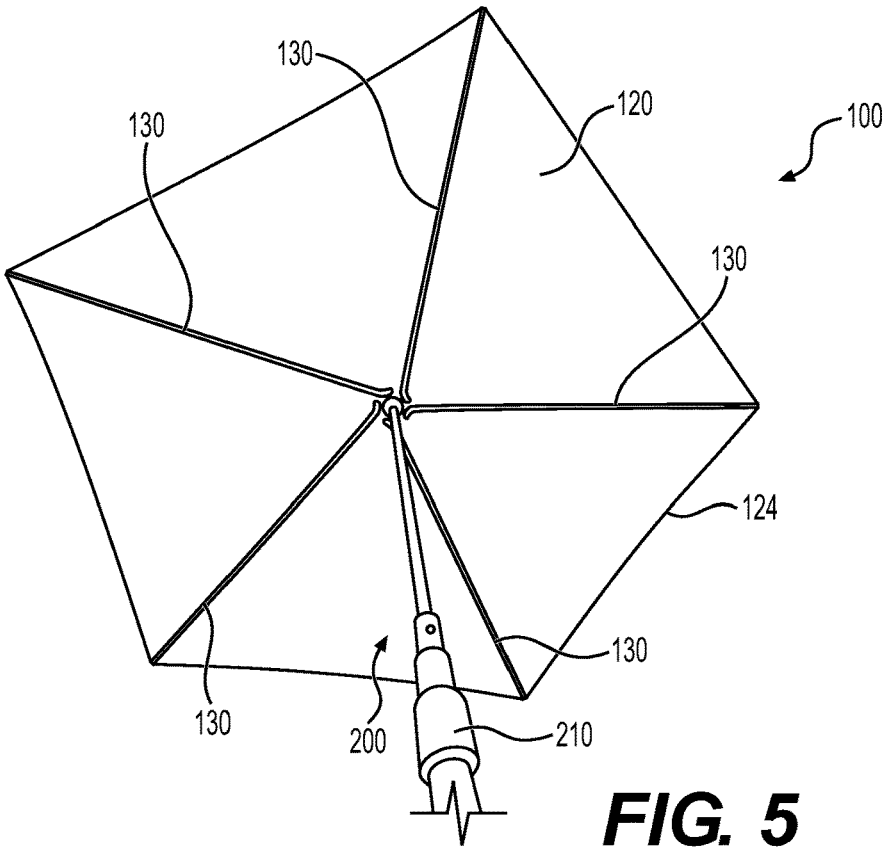
FIG. 5 is a perspective view of the umbrella shown in FIG. 1 showing the underside the canopy.

As shown in FIG. 1, each rib 130 is oriented parallel to the support shaft 110 in the closed position, and the distal end portion 134 pivots upwardly and outwardly to the open position. The support shaft 110 includes a longitudinal axis 102, which in this embodiment is also the longitudinal axis of the umbrella 100 as a whole, and each rib 130 also is oriented parallel to the longitudinal axis 102 in the closed position. With the canopy 120 attached as discussed above, the ribs 130 stretch the canopy 120 to be taut when the ribs 130 are in the open position, as can be seen in FIGS. 4 and 5. FIG. 5 is a perspective view of the umbrella shown in FIG. 1 showing the underside of the canopy. In particular, the canopy 120 includes panels 128 between each of the ribs 130 and in the open position the ribs 130 stretch the panels 128, but in the closed position the panels 128 are slack. A strap (not shown) may be used to secure the umbrella 100 in a closed state. The strap may be secured using hook and loop fasteners, such as Velcro®. Alternatively, two straps (not shown) may be provided on the outer side of the canopy 120 to secure the canopy 120 in the closed state by tying the straps together.

As shown in FIGS. 4 and 5, the ribs 130 have a spiral arrangement, and each rib 130 moves between the open position and the closed position in a plane which does not include the longitudinal axis 102. As will be discussed further below, the ribs 130 are pivotably attached to a fixed hub 160 and not the support shaft. The ribs 130 do not swivel or pivot in a plane or direction that coincides with a radial direction (radius r in FIG. 3A) extending from the longitudinal axis 102 of the support shaft 110, rather the ribs 130 have a spiral pattern. A radius R based on the length of the rib 130 from the pivot point of the rib 130 thus does not coincide with the radius r. For the fabric of the canopy 120 to be taut in the open position, the panels 128 are cut such that the stiches (quilt ribs) are in line with the ribs 130 instead of, for example, in the radial direction r.

Figure 6:
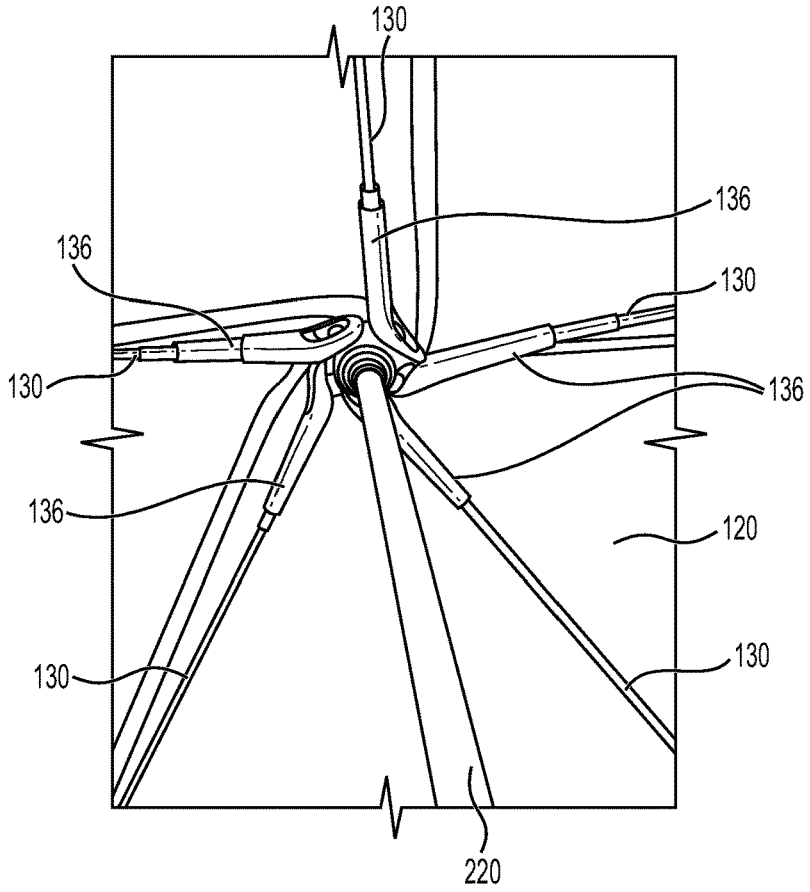
FIG. 6 is a detail view of a hub of the umbrella shown in FIG. 1.

The structure of the umbrella 100, and more specifically the rotatable cam assembly 200 and the connection to the rib 130, discussed herein enables a fewer number of ribs to be used as compared to traditional umbrellas. The umbrella 100 preferably includes at least three ribs 130. In the embodiments shown and discussed herein, the umbrella 100 includes five ribs 130, but any suitable number of ribs 130 may be used. In some embodiments, each of the panels 128 are generally triangular between the ribs 130, with the. The canopy 120 may have a shape (e.g., the outer edge 124 of the canopy) with the same number of sides as the number of ribs 130. In the embodiment shown in FIGS. 4 and 5, for example, the umbrella includes five ribs 130 and the canopy 120 has the shape of a pentagon. In other embodiments, for example, the umbrella 100 may include three ribs 130 and the canopy 120 has the shape of a triangle; may include four ribs 130 and the canopy 120 has the shape of a quadrilateral, such as a rectangle, or more specifically, a square; may include six ribs 130 and the canopy 120 has the shape of a hexagon; may include seven ribs 130 and the canopy 120 has the shape of a heptagon; or may include eight ribs 130 and the canopy 120 has the shape of an octagon. As noted above, the ribs 130 are pivotably attached to the upper portion 112 of the support shaft 110. In this embodiment, the umbrella 100 includes a fixed hub 160 and each rib 130, more specifically the proximal end portion 132 of each rib 130, is pivotably attached to the fixed hub 160. FIG. 6 is a detail view of the fixed hub 160 shown from the perspective of FIG. 5. The fixed hub 160 of this embodiment is fixed (connected) to the upper portion 112 of the support shaft 110.

Figure 7:
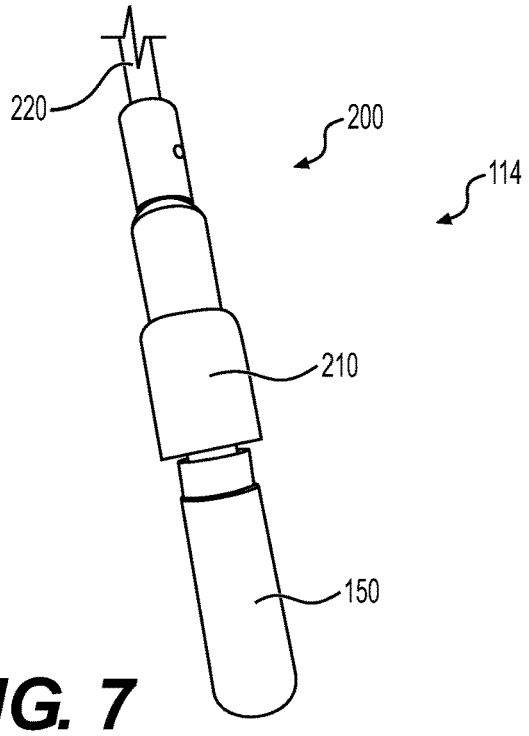
FIG. 7 is a perspective view of the handle of the umbrella shown in FIG. 1.

As shown in FIG. 1 and in more detail in FIG. 7, the umbrella 100 also includes a fixed handle 150. The fixed handle 150 is connected to the lower portion 114 of the support shaft 110. FIG. 7 is a perspective view of the fixed handle 150. The fixed handle 150 is preferably shaped to be held comfortably by a user such that the user can hold the umbrella 100 over his or her head. Any suitable shape may be used including generally cylindrical shapes or hooked shapes. Located above the fixed handle 150 is a movable handle 210. As indicated by the arrows in FIG. 1, the movable handle 210 may be rotated about the longitudinal axis 102 in a first direction to open the umbrella 100 and rotated in a second direction, opposite the first direction, to close the umbrella 100.

Figure 8:
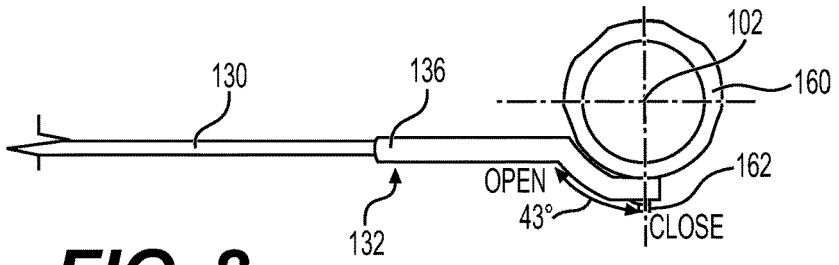
FIG. 8 is a top orthographic view of the hub and ribs of the umbrella shown in FIG. 1.
Figure 9:
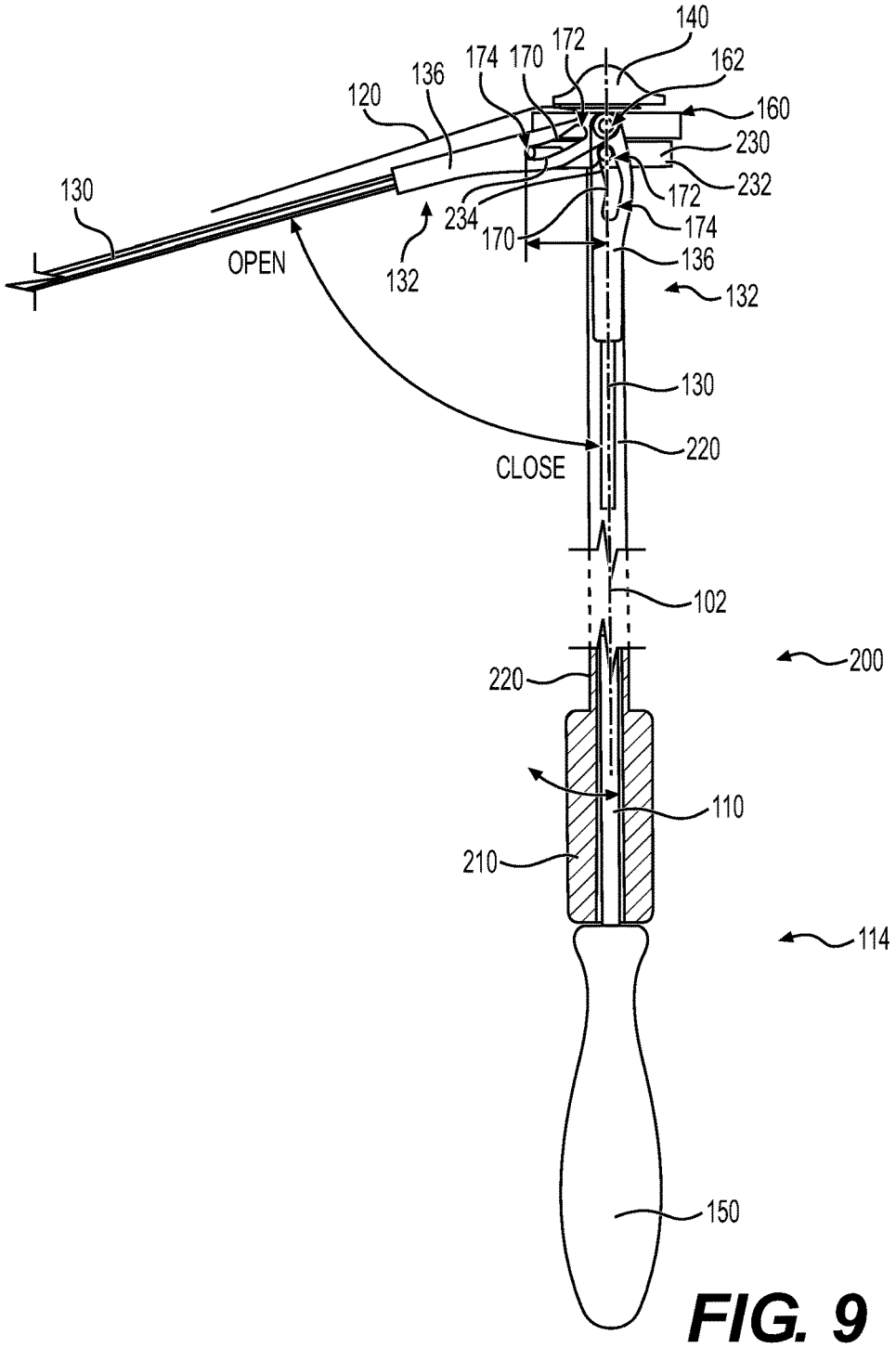
FIG. 9 is a side orthographic view of the hub and ribs shown in FIG. 8.

The movable handle 210 is part of a rotatable cam assembly 200 that is used to move the plurality of ribs 130 between the closed position and the open position. The rotatable cam assembly 200 will be described in more detail with reference to FIGS. 8 and 9. FIG. 8 is a top orthographic view of the fixed hub 160 and one of the ribs 130, and FIG. 9 is a side orthographic view of the fixed hub 160 and one of the ribs 130 corresponding to the features shown in FIG. 8. In FIG. 9, the movable handle 210 is shown in cross section. An arm 136 is located on the proximal end portion 132 of each rib 130. The arm 136, and more specifically, the proximal end of the arm (and thus the rib 130) is pivotably attached to the fixed hub 160 by a pivot 162. Any suitable pivot 162 may be used including a fastener extending through a hole formed in the arm 136 and fastened to the fixed hub 160 such that the arm 136 can rotate about the fastener.

The arm 136 includes a slot 170 formed therein. The slot 170 is elongated in a direction from the proximal end portion 132 to the distal end portion 134 of the rib 130 in which the slot is formed. The slot 170 includes a proximal end 172 and a distal end 174 defining a longitudinal axis 176 of the slot 170. In some embodiments, the slot 170 may be linear from the proximal end 172 to the distal end 174 along the longitudinal axis 176, but in other embodiments, the slot 170 may have a shape, such as a curve shape or a V-shape. In the embodiment shown in FIG. 9, the slot 170 has a V-shape and includes a portion between the proximal end 172 to the distal end 174, which in this embodiment is a central portion 178, that is lower than the longitudinal axis 176 of the slot 170 when the rib 130 is in the open position. The slot 170 is located in a direction toward the distal end portion 134 from the pivot 162.

The rotatable cam assembly 200 also includes a rotatable shaft 220 and a cam 230. The movable handle 210 is connected to the cam 230 and configured to rotate the cam 230 about the longitudinal axis 102 when the movable handle 210 is moved. In this embodiment, the rotatable shaft 220 connects the movable handle 210 and the cam 230. Although indirect connections may be used, the rotatable shaft 220 directly connects the movable handle 210 to the cam 230 such that, when the movable handle 210 is rotated about the longitudinal axis 102, the movable handle 210 rotates the rotatable shaft 220 about the longitudinal axis, and the rotatable shaft 220 rotates the cam 230 about the movable handle 210.

In this embodiment, the support shaft 110 is an inner shaft and extends through each of the movable handle 210, rotatable shaft 220, and cam 230. More specifically, each of the movable handle 210, rotatable shaft 220, and cam 230 are annular having a passage formed therein, and the support shaft 110 extends through the passage. However, other suitable arrangements may be used, for example, the support shaft 110 may be the outer shaft having the passage formed therein and the rotatable shaft 220 may be the inner shaft extending through the support shaft 110.

The cam 230 is engaged with each rib 130 of the plurality of ribs 130 such that each rib 130 moves in a direction from the closed position to the open position when the cam 230 rotates in the first direction and each rib 130 moves in a direction from the open position to the closed position when the cam 230 rotates in the second direction. In this embodiment, the cam 230 includes a rotatable hub 232 having a plurality of radially projecting rods 234. Each rod 234 engages with the slot 170 in a corresponding one of the ribs 130. The rod 234 slides within the slot 170 as the rotatable hub 232 rotates about the longitudinal axis 102. When the rotatable hub 232 rotates in the first direction, each rod 234 slides in the corresponding slot 170 from the proximal end 172 to the distal end 174 to move the corresponding rib 130 from the closed position to the open position. The combination of the rotatable hub 232 and the rod 234 turns the rotational movement of the rotatable hub 232 to translational movement of the rod 234. As the rod 234 sidles (translates) in the slot 170, the rod 234 bears upon (contacts) an upper surface of the slot 170 raising the rib 130 from the closed position to the open position. The rod 234 has a length such that the rod 234 remains engaged with the slot 170 throughout the length of travel as the cam 230 rotates. To close the umbrella 100, the process is reversed. Each rod 234 slides in the corresponding slot 170, from the distal end 174 to the proximal end 172 to move the corresponding rib 130 from the open position to the closed position when the rotatable hub 232 rotates in the second direction.

An advantage of the umbrella 100 and the rotatable cam assembly 200 described herein, is that the umbrella 100 has very good wind resistance. In a conventional umbrella, the ribs are supported by a plurality of stretchers that connect an intermediate point of the rib to the shaft. The frame and the shaft of conventional umbrellas are optimized to be lightweight, so that the user can hold and support the conventional umbrella with one hand. As a result, the stretchers of the frame tend to be relatively thin. When the conventional umbrella is open, strong wind gusts can strike the lower side of the canopy, causing the stretchers to bend in an upward direction, thereby inverting the dome-like shape of the canopy. This renders the umbrella ineffective for protection from precipitation. Further, such an inversion may cause the stretchers to break and, therefore, the umbrella to become unusable.

Figure 10:
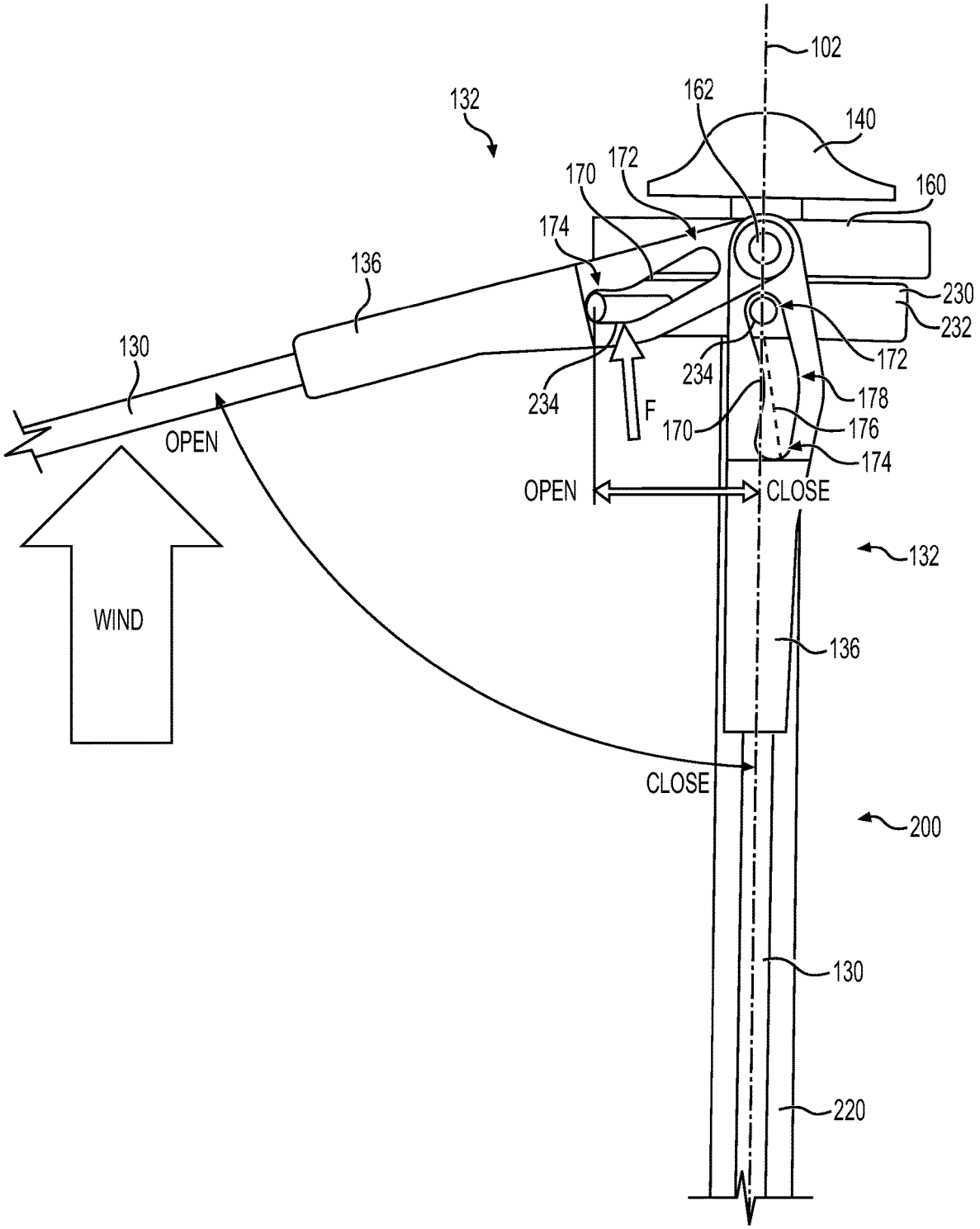
FIG. 10 is a detail, side orthographic view of the hub and ribs shown in FIG. 1.

FIG. 10 is a detail view showing the ribs 130, the fixed hub 160, and the cam 230. As the wind blows on the canopy 120 (not shown in FIG. 10) and the ribs 130 from the underside as indicated by the arrow labeled wind, the resultant force is transmitted to the rod 234 by the lower side of the slot 170 as indicated by the arrow F. This force acts on the rod 234 in sheer and thus the strength and the cross-sectional area of the rod 234 provide strength to hold the shape of the umbrella 100 and prevent inversion. Because of the relatively large diameter of the rod 234, the umbrella 100 can resist large amounts of wind. In view of the strength of the connection between the arm 136 of the rib 130 and the cam 230, the rib 130 is preferably made from a strong material that resists fracture and that is also light weight. In this embodiment, a carbon fiber rod is used to form the rib 130. The carbon fiber is strong, but also allows elastic deformation of the rib 130 during strong wind gusts. Preferably the rib 130 is more flexible than the combination of the connection between the arm 136 of the rib 130 and the cam 230. For example, when the umbrella 100 is in the open position, the rib 130 may flex to the support shaft 110, but the connection between the arm 136 of the rib 130 and the cam 230 is strong enough to not to fail in such conditions. The connection between the arm 136 of the rib 130 and the cam 230 is just as strong as when the wind is acting on the outer surface of the canopy 120. To prevent the cam 230 from rotating in the second direction, a latch may be used, such as the one shown and described below with reference to FIGS. 11-13.

Figure 11:
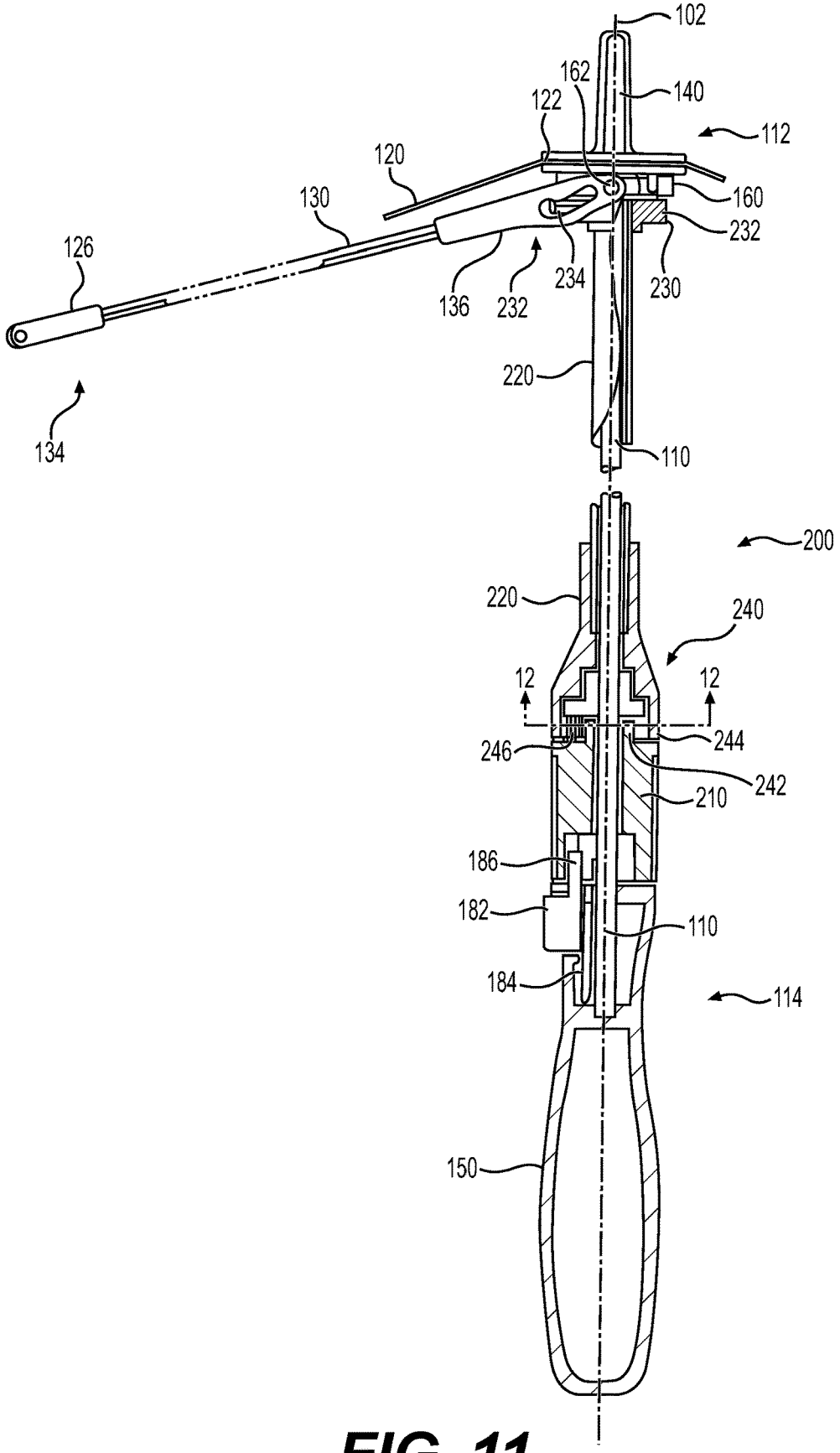
FIG. 11 is the view shown in FIG. 9 illustrating an alternate connection of a movable handle to a rotatable cam assembly.
Figure 12:
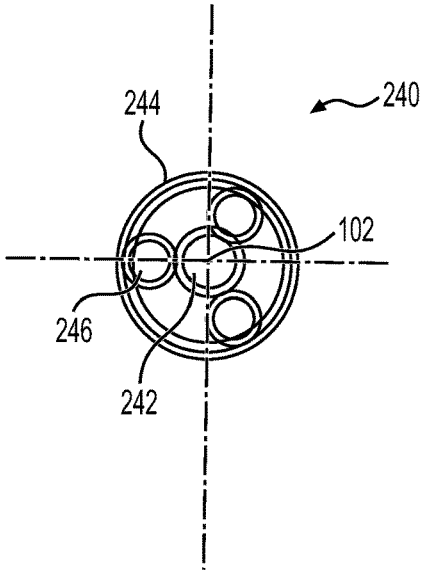
FIG. 12 is a cross-sectional view of a gear configuration of the movable handle taken along line 12-12 in FIG. 11.
Figure 13:
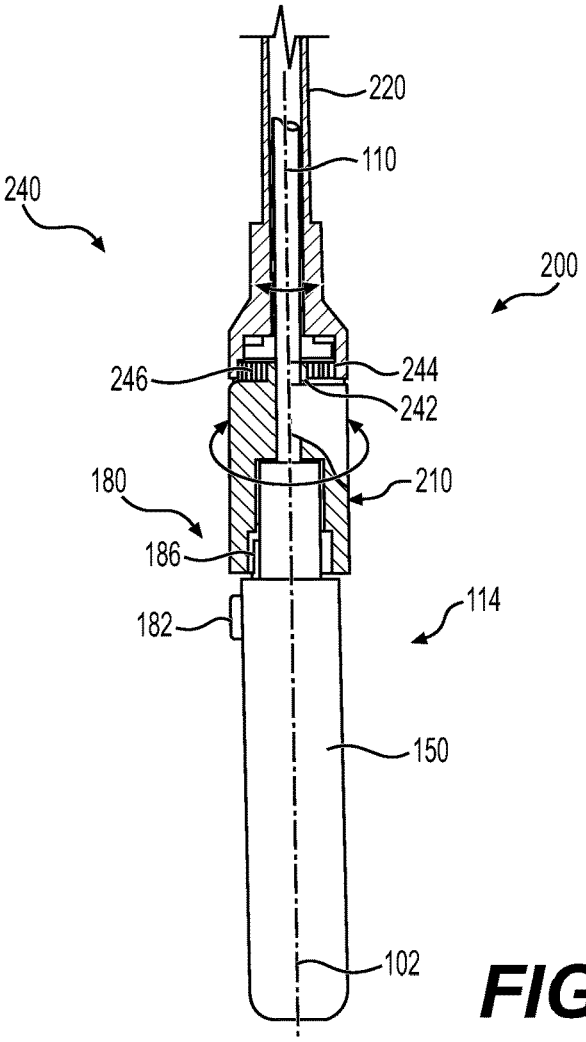
FIG. 13 is a partial cross-sectional view of the handle assembly shown in FIG. 11.

FIGS. 11-13 show another embodiment of the umbrella 100. This embodiment is similar to the embodiment discussed above and like reference numerals are used to refer to the same or similar components in this embodiment. A detailed description of such components is omitted here. In the embodiment discussed above, the movable handle 210 was directly connected to the cam 230 by the rotatable shaft 220. To improve the ease in which the movable handle 210 is rotated, the movable handle 210 is connected to the cam 230 through a gear assembly 240. FIG. 11 is the view shown in FIG. 9 illustrating the connection of the movable handle 210 to the cam 230 by the gear assembly 240. FIG. 12 is a cross-sectional view of the gear assembly 240 of the movable handle taken along line 12-12 in FIG. 11, and FIG. 13 is a partial cross-sectional view of the fixed handle 150 and the movable handle 210 shown in FIG. 11.

The movable handle 210 includes a driving gear 242 and the rotatable shaft 220 includes a driven gear 244. The driving gear 242 of the movable handle 210 is configured to transmit a driving force from the movable handle 210 to the driven gear 244 of the rotatable shaft 220. In this embodiment, the driving gear 242 and the driven gear 244 are integrally molded (formed) with the movable handle 210 and the rotatable shaft 220, respectively.

The gear assembly 240 of this embodiment is a planetary gear arrangement with the driving gear 242 being a sun gear and the driven gear 244 being a ring gear. The gear assembly 240 also includes a plurality of intermediate gears 246 having teeth formed on an exterior surface thereof. Teeth are formed on the exterior of the driving gear 242 and the teeth of each of the intermediate gears 246 mesh with the teeth of the driving gear 242 such that the driving force is transmitted from the driving gear 242 to the intermediate gears 246. As noted above, the driven gear 244 is a ring gear with teeth formed on an interior surface thereof. The teeth of the intermediate gears 246 also mesh with the teeth of the driven gear 244 to transmit the driving force from the intermediate gear 246 to the driven gear 244 and thus the rotatable shaft 220. The driving gear 242 and the driven gear 244 are positioned coaxially with each other and the axis is the longitudinal axis 102. Each of the driving gear 242 and the driven gear 244 are configured to rotate about the longitudinal axis 102.

In this embodiment shown in FIG. 10, the driving gear 242 is attached to, more specifically integrally formed with, the movable handle 210, and the driven gear 244 is attached to, more specifically integrally formed with, the rotatable shaft 220. In other embodiments, different arrangements may be used. For example, the driving gear 242 may be attached to, more specifically integrally formed with, the rotatable shaft 220, and the driven gear 244 may attached to, more specifically integrally formed with, the rotatable hub 232 of the cam 230. By such an arrangement, the driving force required to rotate the handle can be reduced by the appropriate gear ratio. Where the gear ratio of the driving gear 242 to the driven gear 244 (considering the planetary arrangement of the intermediate gears 246) is 1:2, the driving force can be reduced by half as compared to the direct connection arrangement; although it will be appreciated that such an arrangement also results in the movable handle 210 being rotated twice as far as compared to the direct connection arrangement.

As noted above, a locking mechanism 180 may be used to prevent the movable handle 210 and thus the rotatable cam assembly 200 from rotating. An example of such a locking mechanism 180 is shown in FIGS. 11 and 13. The locking mechanism 180 of this embodiment includes a button 182 that protrudes from the fixed handle 150 and may be pressed by the user against a biasing force of a spring 184. The locking mechanism 180 also includes an engagement portion 186 that engages with the movable handle 210. When the button 182 is pressed, the engagement portion 186 disengages from the movable handle 210 allowing the movable handle 210 to rotate. The locking mechanism 180 may be configured to lock the movable handle 210 in discrete positions, such as the open position and the closed position, by having slots formed in an inner surface of the movable handle 210 that the engagement portion 186 engages with.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. An umbrella comprising:

a support shaft including an upper portion, a lower portion, and a longitudinal axis;

a plurality of ribs, each rib of the plurality of ribs having a proximal end portion and a distal end portion, the proximal end portion being pivotably attached to the upper portion of the support shaft to pivot the rib between an open position and a closed position such that the distal end portion pivots upward from the closed position to the open position and downward from the open position to the closed position, the proximal end portion of each of the plurality of ribs including a slot formed therein;

a plurality of projections, each projection of the plurality of projections engaging with a corresponding one of the slots to slide in the slot, the plurality of projections being connected to each other to slide in the slots of the plurality of ribs in concert with each other and move the plurality of ribs between the open position and the closed position as the plurality of projections slide in the slots of the plurality of ribs; and a canopy having an outer edge attached to the distal end portion of each of the ribs.

2. The umbrella of claim 1, further comprising a rotatable hub, the rotatable hub being rotatable about the longitudinal axis in a first rotation direction and in a second rotation direction opposite the first rotation direction, each the plurality of projections being connected to each other by the rotatable hub.

3. The umbrella of claim 1, wherein each projection of the plurality of projections is a rod.

4. The umbrella of claim 1, wherein each slot is elongated in a direction from the proximal end portion to the distal end portion of the rib in which the slot is formed.

5. The umbrella of claim 4, wherein the slot includes a proximal end and a distal end defining a longitudinal axis of the slot, and wherein the slot includes a central portion, the central portion being lower than the longitudinal axis of the slot when the rib is in the open position.

6. The umbrella of claim 4, wherein the slot includes a proximal end and a distal end defining a longitudinal axis of the slot, wherein, when the projection slides in the slot from the proximal end to the distal end, the corresponding rib moves from the closed position to the open position, and wherein, when the projection slides in the slot from the distal end to the proximal end, the corresponding rib moves from the open position to the closed position.

7. An umbrella comprising:

a support shaft including an upper portion, a lower portion, and a longitudinal axis;

a plurality of ribs, each rib of the plurality of ribs having a proximal end portion and a distal end portion, the proximal end portion being pivotably attached to the upper portion of the support shaft to pivot the rib between an open position and a closed position, wherein the distal end portion pivots upward from the closed position to the open position and downward from the open position to the closed position;

a canopy having an outer edge attached to the distal end portion of each of the ribs; and a movable handle connected to the lower portion of the support shaft, the movable handle being configured to rotate about the longitudinal axis in a first rotation direction and in a second rotation direction opposite the first rotation direction, the movable handle being connected to the plurality of ribs such that (i) each rib moves in a direction from the closed position to the open position when the movable handle rotates in the first rotation direction and (ii) each rib moves in a direction from the open position to the closed position when the movable handle rotates in the second rotation direction.

8. The umbrella of claim 7, further comprising a rotatable shaft connecting the movable handle and the plurality of ribs, the movable handle being connected to the rotatable shaft such that, when the movable handle is rotated about the longitudinal axis, the movable handle rotates the rotatable shaft about the longitudinal axis.

9. The umbrella of claim 8, wherein the movable handle is directly connected to the rotatable shaft.

10. The umbrella of claim 8, wherein the movable handle includes a driving gear configured to transmit a driving force from the movable handle and the rotatable shaft includes a driven gear configured to receive the driving force from the driving gear.

11. The umbrella of claim 10, further comprising at least one intermediate arranged relative to the driving gear and the driven gear to transmit the driving force from the driving gear to the driven gear.

12. The umbrella of claim 10, further comprising a plurality of intermediate gears, the plurality of intermediate gears being arranged in a planetary gear arrangement with the driving gear and the driven gear, the intermediate gears being configured to mesh with the teeth of the driving gear and the teeth of the driven gear to transmit the driving force from the driving gear to the driven gear.

13. The umbrella of claim 12, wherein the driving gear is a sun gear and the driven gear is a ring gear.

14. The umbrella of claim 7, further comprising a fixed handle connected to the lower portion of the support shaft.

15. The umbrella of claim 14, wherein the fixed handle is located lower than the movable handle.

16. The umbrella of claim 7, further comprising a rotatable cam assembly including a cam connected to the movable handle to rotate about the longitudinal axis when the movable handle rotates in the first rotational direction and the second rotational direction, the cam engaging with each rib of the plurality of ribs to move each rib in the direction from the closed position to the open position when the movable handle rotates in the first rotation direction and in the direction from the open position to the closed position when the movable handle rotates in the second rotation direction.

17. An umbrella comprising:

a support shaft including an upper portion, a lower portion, and a longitudinal axis;

a plurality of ribs, each rib of the plurality of ribs having a proximal end portion and a distal end portion, the proximal end portion being pivotably attached to the upper portion of the support shaft to pivot the rib between an open position and a closed position such that the distal end portion pivots upward from the closed position to the open position and downward from the open position to the closed position, each of the plurality of ribs moving between the open position and the closed position in a plane which does not include the longitudinal axis; and a canopy having an outer edge attached to the distal end portion of each of the ribs, the canopy including a plurality of panels, the panels being joined to each other at a seam, the panels being shaped such that each seam is positioned in a direction that intersects a radial direction of the canopy.

18. The umbrella of claim 17, wherein the canopy further includes an inner edge, the inner edge of the canopy defining a central hole configured to be detachably connected to the upper portion of the support shaft.

19. The umbrella of claim 18, further comprising a cap assembly configured to be detachably engaged with the upper portion of the support shaft and the central hole of the canopy.

20. The umbrella of claim 17, wherein each seam is substantially aligned with a corresponding rib.

* * * * *